US005476085A

United States Patent [19]

Becker et al.

[11] Patent Number: 5,476,085

[45] Date of Patent: Dec. 19, 1995

[54] METHOD FOR METERING FUEL TO AN INTERNAL COMBUSTION ENGINE IN CONJUNCTION WITH A HOT START

[75] Inventors: Rüdiger Becker, Murr; Wolfgang Körfer, Gerlingen-Gehenbühl, both of Germany

[73] Assignee: Robert Bosch GmbH, Stuttgart, Germany

[21] Appl. No.: 98,078

[22] Filed: Jul. 28, 1993

[30] Foreign Application Priority Data

Jul. 28, 1992 [DE] Germany ..... 42 24 893.0

[51] Int. Cl.[6] ..... F02D 41/06; F02D 41/14

[52] U.S. Cl. ..... 123/685

[58] Field of Search ..... 123/685, 686

[56] References Cited

U.S. PATENT DOCUMENTS

| | | | |
|---|---|---|---|
| 4,528,963 | 7/1985 | Bessho et al. | 123/491 |
| 4,777,924 | 10/1988 | Fujimura et al. | 123/685 |
| 5,021,959 | 6/1991 | Jundt et al. | 123/686 |

FOREIGN PATENT DOCUMENTS

| | | | |
|---|---|---|---|
| 0027848 | 2/1983 | Japan | 123/685 |
| 59-090740 | 5/1984 | Japan . | |
| 0031633 | 2/1986 | Japan | 123/685 |
| 62-017337 | 1/1987 | Japan . | |
| 63-124845 | 5/1988 | Japan . | |
| 0113173 | 5/1988 | Japan | 123/685 |
| 3199641 | 8/1991 | Japan . | |

*Primary Examiner*—Henry C. Yuen
*Assistant Examiner*—Thomas N. Moulis
*Attorney, Agent, or Firm*—Walter Ottesen

[57] ABSTRACT

The invention is directed to a method for metering fuel for an internal combustion engine having a lambda control. In the method, characteristic parameters of the lambda control are changed in conjunction with a hot start of the engine. A leaning of the fuel mixture can be countered in a targeted manner by utilizing the lambda control to enrich the mixture. The bandwidth of the vaporizing performance of possible fuel types must not be covered by an averaged enrichment factor. For this reason, and for intense leaning of the fuel mixture, far greater enrichment factors are possible. The advantages afforded are that the additional measures such as raising the idle rpm are only initiated when actual hot idle problems are present. This is a further advantage in conjunction with the method of the invention. The measures of raising the idle speed can be used much more than previously since these problems occur infrequently and are clearly selectable with the aid of the method of the invention.

8 Claims, 4 Drawing Sheets

METHOD FOR METERING FUEL TO AN INTERNAL COMBUSTION ENGINE IN CONJUNCTION WITH A HOT START

FIELD OF THE INVENTION

The invention relates to a method for improving the operating performance of an internal combustion engine after a hot start, that is, after a short interruption in the operation of the engine.

BACKGROUND OF THE INVENTION

At standstill after a previous operation, an internal combustion engine heats its surroundings whereby fuel-conducting parts such as injection valves and lines are especially affected. Vapor bubbles can then form and lead to an inadequate supply of the engine with fuel when the engine is restarted; that is, the vapor bubbles can lead to an unwanted leaning of the mixture. A poor startup and idle performance results as a consequence. Relationships between hot-start conditions and the formation of vapor bubbles in the fuel system are disclosed, for example, in U.S. Pat. No. 4,951,633.

Known methods provide a compensation of the unwanted leaning of the mixture by means of a controlled enrichment in dependence upon the temperatures of the engine and the intake air. This enrichment is reduced in a controlled manner and finally set to zero in dependence upon the elapse of time from the hot start.

These measures are primarily suitable to compensate for a leaning of the fuel mixture occurring for a short time after a start. The term "short term" is intended here to be a time interval in the order of magnitude of one minute. Furthermore, the stabilization of the idle operation above an increased idle rpm is known.

The amount and the time duration of the unwanted leaning of the mixture by the formation of vapor bubbles is influenced, on the one hand, by the geometry of the arrangement of the engine and the fuel-metering parts and, on the other hand, by the quality of the fuel used.

An especially critical geometry is present, for example, in a V-engine wherein the injection valves and the feed lines (fuel rail) lie between the two cylinder banks and are covered from above by the intake pipe. With this arrangement, the heat transfer to the fuel rail is facilitated while at the same time the cooling of the fuel rails by convection is hindered.

Experiments show that especially under these conditions after a hot start even an intense leaning of the mixture exceeding lambda=1.5 occurs over the time interval of several minutes which is accompanied by intense fluctuations in the value of lambda.

The controlled enrichment according to the state of the art cannot completely compensate the disturbances in mixture because of the extent of the vaporization performance of possible types of fuel available.

SUMMARY OF THE INVENTION

It is an object of the invention to provide an improved method to compensate for the above-mentioned problems after a hot start of an engine.

A leaning of the fuel mixture can be countered in a targeted manner by means of the utilization of the lambda control of the invention for enriching the fuel mixture. In contrast to the state of the art, enrichment takes place only when a leaning of the mixture is detected. It is not necessary to cover the range of vaporization performance of possible fuel types by means of a mean enrichment factor. For this reason, much greater enrichment factors are possible for intense leanings of the mixture. A further advantage of the invention in conjunction with an embodiment thereof is that additional measures such as raising the idle rpm are initiated only when actual hot idle problems are present. These occur infrequently and are clearly selectable with the aid of the method of the invention. For this reason, the measure of increasing idle rpm can be used to a much greater extent than previously. The operations provided by the invention for modern engine control systems require no additional complexity with respect to hardware; rather, the introduction of these functions is possible without difficulty by means of modifications in the control apparatus.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
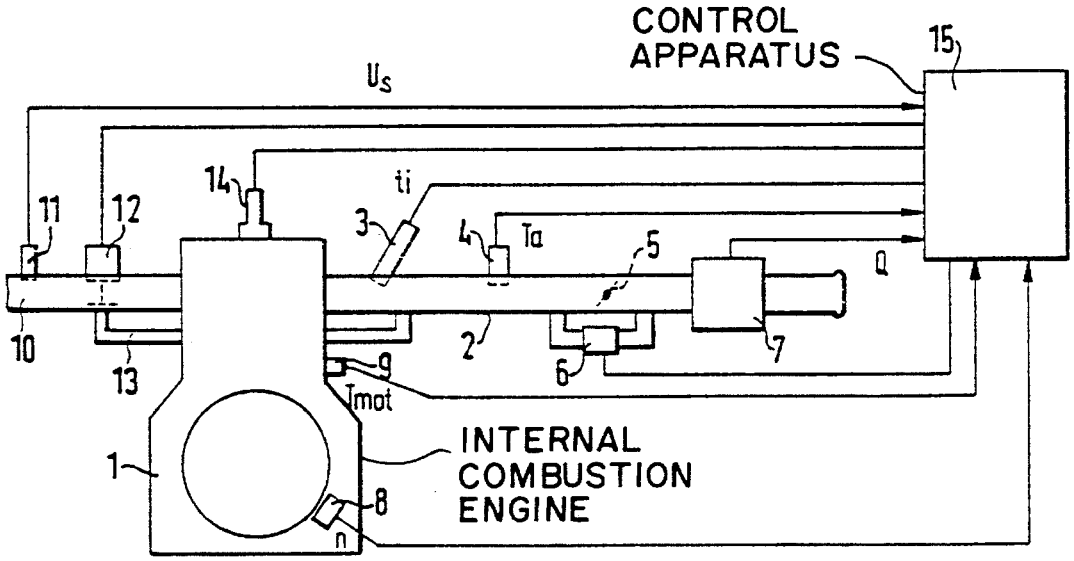
FIG. 1 is a schematic showing an internal combustion engine equipped with various system components for use during its operation and a control apparatus.

FIG. 1 shows an internal combustion engine 1 having an intake pipe 2, an injection valve 3, a sensor 4 for detecting the temperature Ta of the intake air, a throttle flap 5, an idle actuator 6, means 7 for detecting the air quantity Q supplied to the engine, a sensor 8 for detecting the rpm (n) of the engine, a sensor 9 for detecting the temperature Tmot of the engine, an exhaust pipe 10 having an exhaust-gas sensor 11, an exhaust-gas return valve 12, an exhaust-gas return line 13, parts of an ignition device 14 and a control apparatus 15.

Figure 2:
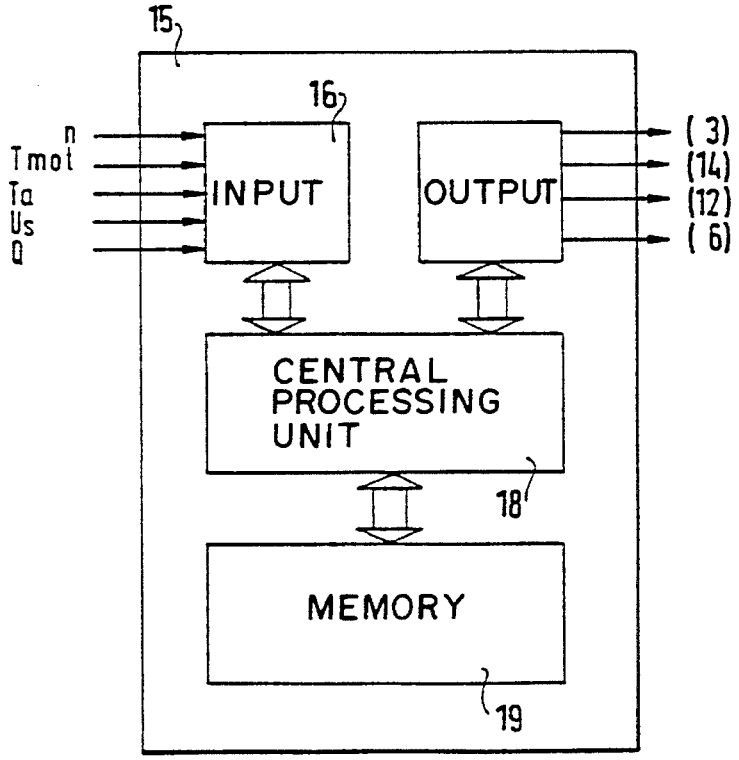
FIG. 2 is a schematic block diagram of the control apparatus shown in FIG. 1.

FIG. 2 shows the known control apparatus 15 in the form of function blocks. Signals of the sensors shown in FIG. 1 are supplied to an input block 16. An output block 17 supplies, for example, drive pulses for the injection valves, the ignition device, the exhaust-gas feedback, the idle actuator and other devices as required such as a tank-venting device. A computing unit 18 mediates between the two blocks in accordance with a program which is stored in the memory 19. In addition, the memory 19 contains data which is used to operate the engine such as characteristic fields for injection times or control parameters which are addressed via operating parameters such as load and rpm.

The arrangement shown depicts the technical environment in which the invention is applied. The function of this arrangement is known per se to persons of ordinary skill and will be explained in the following only where the arrangement is affected or changed by the invention. The subject matter of the invention is disclosed in FIG. 3 which shows an embodiment of the invention in the form of function blocks. Block 1 symbolizes the internal combustion engine together with other components such as injection valves and sensors which are not shown explicitly. The remaining blocks exemplify functions as delineated below:

Block 20: detection of a hot start;

Block 21: forming an actuating variable for the lambda control;

Block 22: forming a fuel-metering signal;

Block 23: making available a first set of control parameters for the lambda control;

Block 24: making available a second set of control parameters for the lambda control; and, Switching means 25: switchover from the first set to the second set of control parameters.

In normal operation (that is, for an operationally ready lambda control without hot-start conditions), the controller (block 21) forms an actuating variable FR from a signal which characterizes the exhaust-gas composition. This actuating variable FR is preferably converted multiplicatively with a base value tp to a fuel-metering signal. This base value tp is formed from values for load Q and rpm (n). In this embodiment, the fuel-metering signal is, for example, an opening time ti for an injection valve 3.

The time response for the actuating variable FR is essentially determined by the values of the control parameters such as proportional, integral or differential components of a PID-controller as well as upper and lower limits of a control intervention.

Usually, mutually opposing requirements such as rapid reaction capability and low tendency to control oscillations are imposed on a control. For this reason, the selection of the control parameters always defines a compromise for the normal operation of the engine.

For the subject matter of the invention, these parameters, which are intended for the normal operation of the engine, are changed in the case of a hot start.

For this purpose, after a start of the engine, a determination is made in block 20 as to whether characteristic conditions for a hot start are satisfied. The temperature Tmot of the engine and the temperature Ta of the intake air are supplied to block 20 and compared to predetermined threshold values.

It can here be advantageous to couple the threshold value of the temperature of the intake air to the value which was measured when switching off the engine. It is known that the value for the temperature of the intake air measured in the region of the intake pipe first increases after the warm engine is switched off. If a temperature increase is determined with the next restart of the engine which is greater than, for example, 12° C., this applies as a criterion for a hot start.

Block 20 initiates a change of a switching position of the switching means 25 when there is a detected hot start. The switching means 25 connects either the block 23 or the block 24 to the controller 21. In addition, a possible available adaptation of the lambda control is blocked and the known control enrichment of the mixture is initiated as required. The two last-mentioned steps are not shown in the drawing for reasons of clarity.

The function of each one of the individual ones of the two blocks 23 and 24 comprises making respective sets of control parameters available which become effective in the controller 21 for a corresponding switch position of the switching means 25. The term control parameter here identifies the P-component, I-component and D-component of a PID-controller as well as the values of limitations of the upper and lower control intervention.

For example, the block 23 can supply the set of control parameters for normal operation of the engine; whereas, block 24 can make available the special values adapted to the hot-start conditions.

Figure 4A:
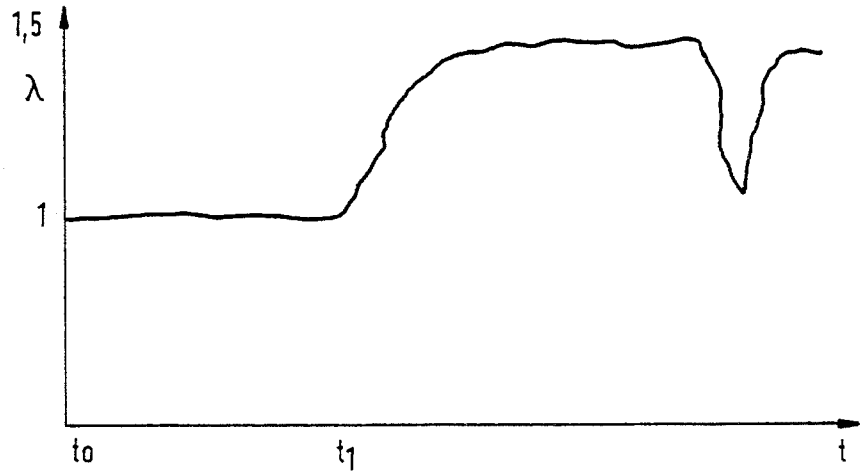
FIGS. 4*a* to 4*c* show the operation of the invention with the aid of respective signal traces.
Figure 4B:
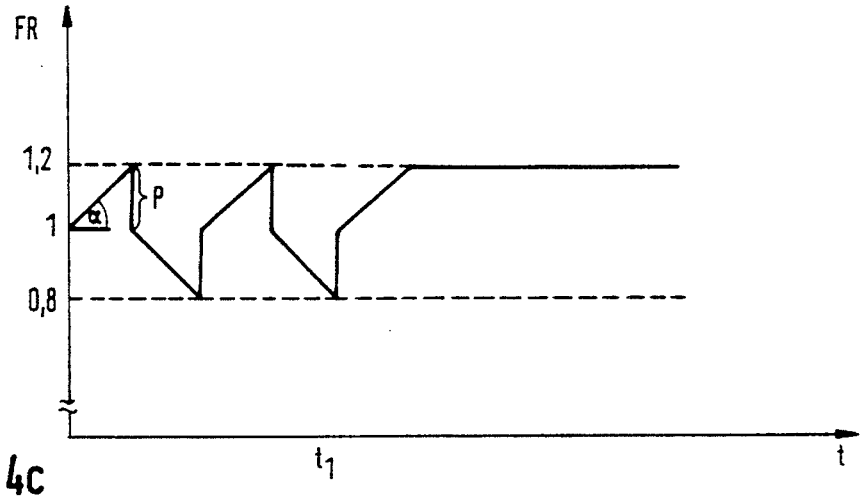
Figure 4C:
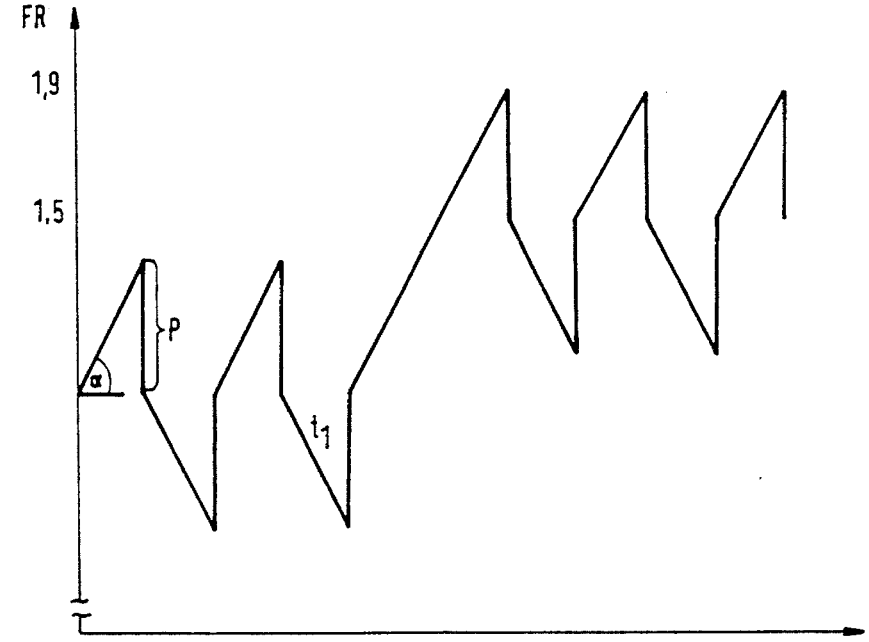

The nature as well as the effect of the change is made clear in the signal traces of FIGS. 4*a* to 4*c*.

FIG. 4*a* shows a typical trace of lambda as it can occur after a hot start when no countermeasures whatsoever are undertaken. First vaporized fuel is present in the fuel rail after a hot start at time point t0. Under these circumstances, no significant formation of vapor bubbles occurs and therefore also no unwanted leaning of the mixture occurs. If fuel from the tank reaches the heated fuel rail at time point t1, the slightly volatile components form vapor bubbles and a leaning occurs which reaches values up to lambda=1.5 in the embodiment shown.

FIG. 4*b* shows a typical reaction of the control factor FR as it occurs under the same conditions in normal operation when the lambda control is operationally ready with control parameters intended for normal operation. Neither the bandwidth of the control intervention (here extending from FR=0.8 to FR=1.2) nor the control speed (determined by the height of the proportional jumps p and the integrator slope I=tan a) are adapted to the massive disturbances caused by the formation of vapor bubbles. For the conditions shown, the controller runs up to its upper limit after the occurrence of the vapor bubbles for which limit the exemplary value FR=1.2 was assumed here.

As already mentioned above, a controlled enrichment to compensate for the remaining misadaptation by the factor 0.3 (which, in this embodiment, results as a difference between the amounts of the disturbance 1.5 and the maximum controller reaction 1.2), is only poorly suitable because of the bandwidth of the vapor performance of possible fuel types.

The effect of the method of the invention is shown in FIG. 4*c*. Changed control parameters come into operation after a detected hot start at time point t0. The increased control speed can be detected on increased values for I=tan a and p and makes possible a comparatively rapid reaction to disturbances caused by the formation of vapor bubbles. The increased control range makes it possible for the control to control out the intense long-term deviation to values up to lambda=1.5.

Figure 3:
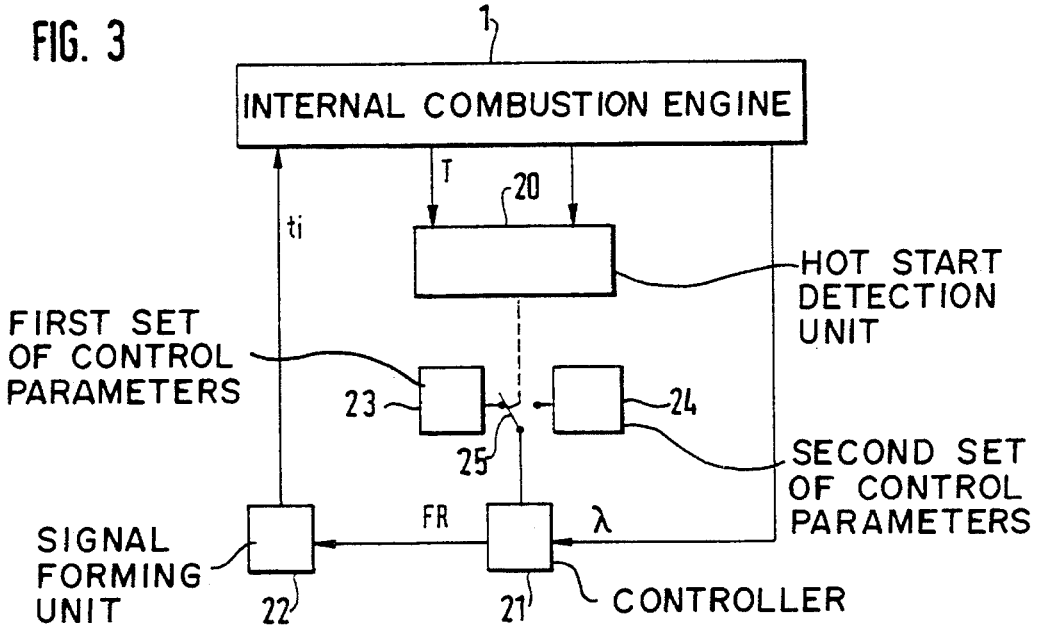
FIG. 3 is a function block diagram for explaining the method of the invention.
Figure 5:
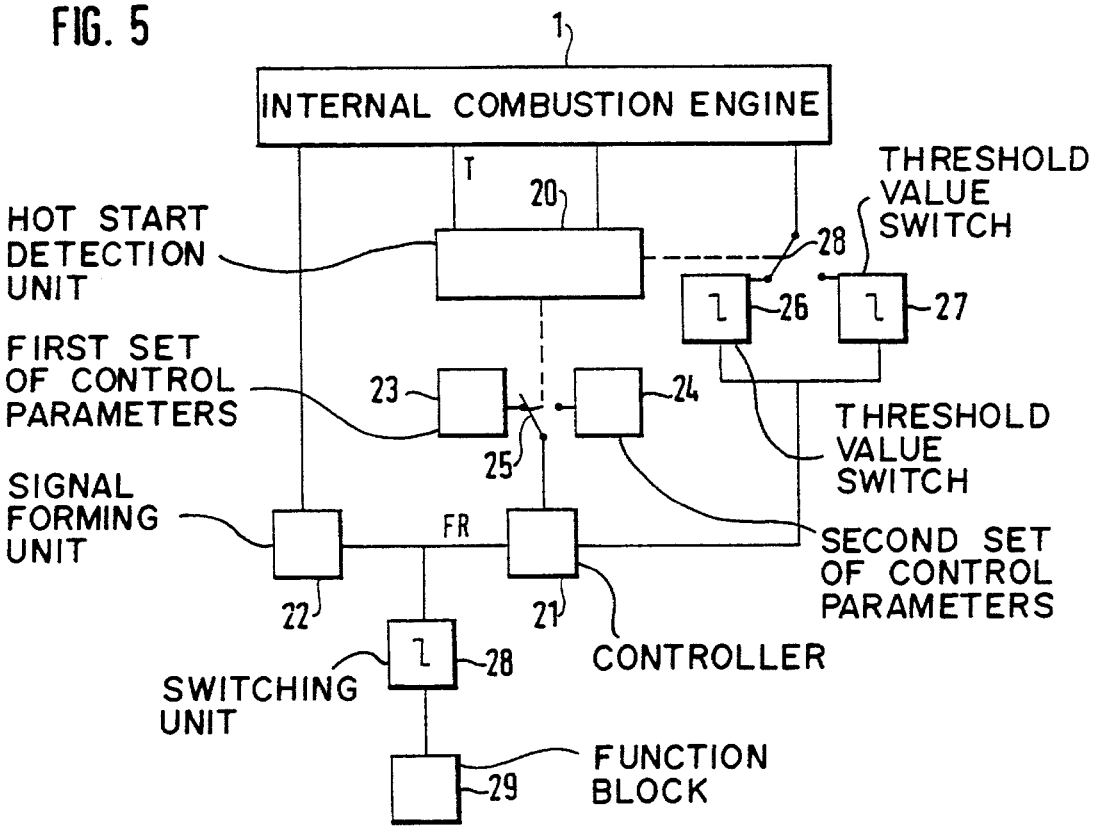
FIG. 5 is a further block diagram showing the operation of the invention; and, FIGS. 6*a* and 6*b* show a flowchart showing the steps suitable for carrying out the method of the invention.

FIG. 5 shows a further embodiment of the method of the invention which is expanded by two functions with respect to the subject matter of FIG. 3.

The first expansion is for the case of a hot start wherein the lambda control is not operationally ready. In this case, measures are undertaken to accelerate reaching operational readiness.

It is known, for example, to permit control to begin after a start only when the lambda probe supplies an adequately high signal voltage. The blocks 26 and 27 represent threshold value switches which transmit this signal to the controller 21 only when a threshold value is exceeded. The connection of the engine to the controller 21 in the drawing represents the transmission path for the signal of the lambda probe. The position of the switching means shown corresponds to the normal operation without hot-start conditions. In this case, the signal of the lambda probe should reach a comparatively high amplitude before the control is permitted. Here, the assumption is made that a control under these conditions will first supply better results, for example, in the running performance of the engine or in the quality of the exhaust gas.

According to the invention, a control is already permitted for a comparatively low signal amplitude in the case of a hot start.

In this embodiment, and for this purpose, the signal of the lambda probe is supplied via switch 28 to a second threshold-value switch 27 and compared to a correspondingly reduced threshold value. The switch 28 is controlled by the hot-start detection block 20. Even though this voltage signal in normal operation is only conditionally suitable for control, it supplies the better result in comparison to the open loop control for the intense leaning of the fuel mixture in the hot-start case with the leaning of the mixture fluctuating intensely in amount and duration, for example, with the quality of the fuel.

The procedure described can also be used in other methods for detecting operational readiness. What is essential is that each applicable criterion of operational readiness is so attenuated that the time point of use of the control in the case of a hot start is reached comparatively earlier.

In addition, further measures for heating the lambda probe can be initiated for accelerating the realization of operational readiness. Such measures include retarding the ignition or raising the idle speed.

The second expanded function shown by blocks 28 and 29 is intended to ensure the operation of the engine, for example, when an intense leaning of the fuel mixture occurs during the idle operation of the engine.

Block 28 symbolizes a threshold-value inquiry in which the control factor FR is compared to a pregiven lean corrective threshold value which is greater than 1. The function block 29 is activated when the formation of vapor bubbles leads to such an intense leaning of the fuel mixture that the lean correction (FR>1) exceeds the above-mentioned threshold value.

Block 29 represents measures which increase the torque of the engine. This increase in torque can, for example, take place via an increase of the idle engine speed, a change in the ignition angle, but also via a switch-off of loads such as a possibly available climate control or by switching off disturbing variables such as the tank venting.

Figure 6A:
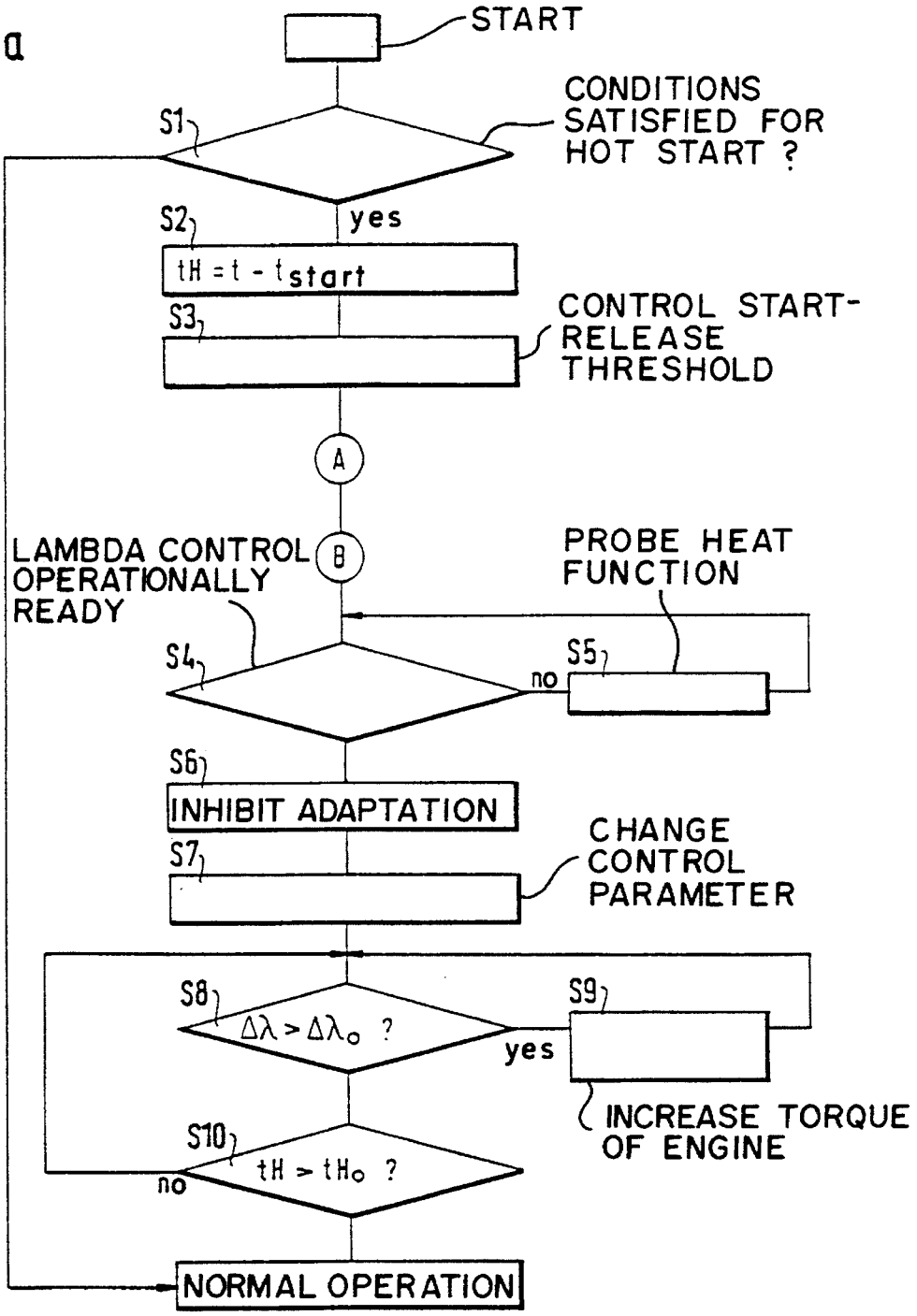

The flowchart of FIG. 6*a* shows the steps suitable for carrying out the method of the invention. These steps also include steps which are carried out in the context of the alternate embodiment of FIG. 5.

After a start of the engine, a determination is first made in a step S1 whether characteristic conditions for the hot start are satisfied. As already described, the temperatures Tmot of the engine and the temperature Ta of the intake air can, for this purpose, be compared to pregiven threshold values. If no hot start is present, the program branches to normal operation, that is, to a known engine control program. If in contrast, a hot start is present, then a time tH is defined in a step S2 which, in a further program sequence, provides the time elapsed since the start. Thereafter, in step S3, the threshold is reduced and, starting from this threshold, the lambda probe signal for control is used. These steps correspond to the function symbolized by the blocks 26 and 27 of FIG. 5.

An inquiry as to the operational readiness of the lambda probe takes place in the following step S4. A lambda probe which is not operationally ready initiates the following in step S5: a probe heater function, an increase of the idle engine speed, a shift of the ignition in the direction to retard, or a combination of these measures. If the lambda control is operationally ready, a possibly available adaptation of the lambda control is switched off in a step S6 before, in step S7, the change according to the invention of the control parameters follows, as was explained in connection with FIGS. 3 and 4.

The step S8 serves for detecting a lean correction in correspondence to the function of block 28 of FIG. 5. If $\Delta\lambda$ is greater than a predetermined threshold value, then the torque of the engine is influenced in step S9 in the manner explained in connection with block 29 of FIG. 5.

A check is made in step S10 as to whether a maximum time tHO has elapsed since the hot start of the engine and, after this maximum time has elapsed, the program branches off to normal operation. If this time has not yet been reached, then the loop of the steps S8 and S9 is run through repeatedly. The measures for increasing the torque of the engine are cancelled when the lean correction of step S8 again drops below the above-mentioned threshold value.

Figure 6B:
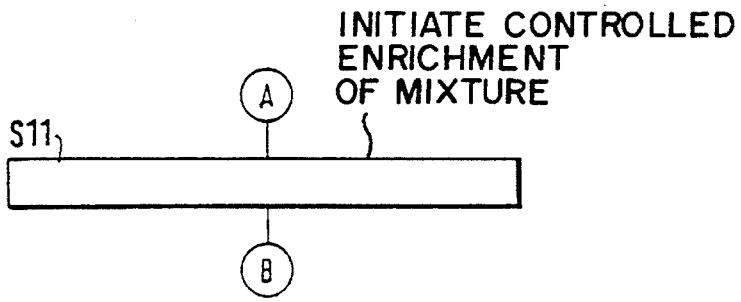

FIG. 6*b* shows, with step S11, the triggering of a controlled enrichment for compensating the leaning of the mixture occurring for a short time after a hot start of the engine. This known method is indicated by the marks A and B in FIG. 6*a* and can be used in the context of the invention as a supplement.

It is understood that the foregoing description is that of the preferred embodiments of the invention and that various changes and modifications may be made thereto without departing from the spirit and scope of the invention as defined in the appended claims.

What is claimed is:

1. A method for metering fuel to an internal combustion engine equipped with a lambda control path which includes a lambda probe supplying an output signal, the method comprising the steps of:

forming a base value for metering fuel to the engine in dependence upon operating parameters thereof;

superposing an actuating variable on said base value, at least intermittently, said actuating variable being based on said signal of said lambda probe and said lambda control path;

initiating measures to compensate a disturbance of the fuel mixture when specific conditions characterizing a hot start are present when the engine is started;

forming a quantity based on said actuating variable and comparing said quantity to a predetermined threshold value; and, initiating at least one measure to increase the torque of the engine when said quantity exceeds said predetermined threshold value.

2. The method of claim 1, further comprising the steps of: measuring the temperature (Tmot) of the engine and the temperature (Ta) of the intake air; and, characterizing a start of the engine as a hot start when, in conjunction with the start, at least one of said temperatures (Tmot or Ta) exceeds a predetermined threshold value.

3. The method of claim 1, as an additional measure, further comprising the step of increasing at least one of the following variables of said lambda control: control range, integral component, proportional component or differential component.

4. The method of claim 1, further comprising the step initiating at least one of the following measures to increase said torque when said threshold value is exceeded: increasing the idle rpm; switching off possible loads such as the drive for climate control equipment; and, switching off other disturbing variables such as exhaust gas return and tank venting.

5. The method of claim 1, further comprising, after a hot start with a lambda probe which is not operationally ready, initiating measures for an accelerated activation of the lambda control.

6. The method of claim 5, further comprising initiating at least one of the following measures: increasing the idle rpm; retarding the ignition to later time points; and, advancing the time point of the start of the lambda control.

7. The method of claim 1, further comprising the step of carrying out a controlled enrichment of the fuel mixture.

8. The method of claim 2, wherein the threshold value for the temperature (Ta) of the intake air is determined by a pregiven offset $\Delta t$ with respect to the measured value of the temperature of the intake air for the previous switch off of the engine.

* * * * *